United States Patent [19]

Kataoka

[11] Patent Number: 4,629,531

[45] Date of Patent: Dec. 16, 1986

[54] APPARATUS FOR JOINING SHEET ENDS

[76] Inventor: Hiroshi Kataoka, 3686 Samukawacho, Iyo-Mishima-shi, Ehime-ken, Japan

[21] Appl. No.: 686,887

[22] Filed: Dec. 27, 1984

[30] Foreign Application Priority Data

Dec. 28, 1983 [JP] Japan ..... 58-199382

[51] Int. Cl.[4] ..... B65H 19/18; B65H 19/20

[52] U.S. Cl. ..... 156/504; 156/159; 156/497; 156/510; 242/56 R; 242/58.2; 242/58.4; 242/58.5

[58] Field of Search ..... 156/157, 159, 504, 505, 156/510, 497; 242/56 R, 58.1, 58.2, 58.4, 58.5

[56] References Cited

U.S. PATENT DOCUMENTS 3,847,708 11/1974 Takahashi et al. ..... 156/510

4,065,344 12/1977 Weist ..... 156/510

4,081,312 3/1978 Cristiani ..... 156/504

4,450,039 5/1984 Salvucci et al. ..... 156/159

*Primary Examiner*—Michael Wityshyn

*Attorney, Agent, or Firm*—Oblon, Fisher, Spivak, McClelland & Maier

[57] ABSTRACT

An apparatus for joining the trailing end of a preceding sheet to the leading end of a following sheet is disclosed which effects the union of the two sheet ends by keeping the trailing end of the preceding sheet sucked to the lower side of a pair of suction boxes disposed on a sheet path as separated by an interval, cutting the sheet so held in place along the interval, elevating a movable receiving table disposed below the sheet path, and holding in place the leading end of the following sheet, thereby bringing the leading end of the following sheet into contact with the cut end of the preceding strip of sheet and thereby allowing the two sheet ends to be joined.

9 Claims, 7 Drawing Figures

S1
S'1
S''1
S2
S'2
1a
1b
c
2
3
4
4a
4b
8
10
10'
11
12
13
14
15
17
18
19
25
R2

APPARATUS FOR JOINING SHEET ENDS

FIELD OF THE INVENTION

This invention relates to an apparatus for use in an operation of unreeling a sheet from a roll to join the trailing end of the unreeled sheet to the leading end of a sheet from a newly supplied roll.

DESCRIPTION OF THE PRIOR ART

In the unreeling of sheet material for feeding to a subsequent step, it is common to employ a turret type sheet unreeler which is provided at two points opposed to each other across its axis of rotation with the seats for mounting rolls. Heretofore, the unreeling operation has been carried out by unreeling sheet from one roll of sheet mounted at one of the two positions on the turret frame, keeping a new roll of sheet mounted at the other position on the turret frame, keeping the leading end of the sheet from the new roll pulled out onto a sheet connecting table disposed on the outlet side of the unreeler, stopping the discharge of the sheet from the first-mentioned roll immediately after the trailing end of the sheet separates from the core of the roll, superposing the separated trailing end of the sheet on the leading end of the sheet of the new roll on the sheet connecting table, joining the two ends by pressure, restarting the discharge of sheet, rotating the turret by 180° after the rewinding of sheet is started in the next step, removing the core of the spent roll from its position on the turret frame, and setting a new roll of sheet in its place. This operation of sheet joining has been manually performed by two or three workers and, therefore, has entailed the risk that the appearance of the sheet being rewound may be spoiled. In particular, when the sheet is a woven fabric whose fibers are liable to shift position, the fibers in the end portions are liable to be disarranged if pinched between the finger tips. It has been necessary, therefore, to keep extra sheet edges superposed respectively on the fabric sheets during the joining of the sheet ends and, after completion of the sheet end joining, to cut the extra sheet edges off the fabric sheets. Thus, the operation has proved quite inefficient.

OBJECTS OF THE INVENTION

An object of this invention is to provide an apparatus for joining sheet ends, which apparatus permits the operation of joining the sheet ends to be performed easily by one worker and enables the sheet ends to be joined accurately in position.

Another object of this invention is to provide an apparatus for joining sheet ends, which apparatus permits the sheet ends to be quickly joined without spoiling their appearance.

SUMMARY OF THE INVENTION

The apparatus for joining sheet ends according to this invention comprises a pair of sheet suction boxes disposed as separated by an interval on the path of travel of the sheet, sheet cutting means disposed below the aforementioned interval and adapted to cut the sheet sucked to the lower sides of the suction boxes along the interval, and a movable stand disposed below the path of travel of the sheet, provided with a support surface for retaining the leading end of a sheet to be joined, and adapted to rise during the operation of sheet end joining and bring the aforementioned leading end of the sheet into contact with the cut end of the sheet.

When the sheet from the roll being unwound is completely exhausted, the trialing end of the sheet is sucked to the lower side of the suction box and, in that state, cut at a stated position. The leading end of a sheet from the succeeding roll is retained on the movable stand, which is adapted to be moved so as to be accurately brought into contact with the aforementioned cut end of the sheet at the stated position. Consequently the leading end of the sheet is guided by the movable stand to the cut end of the sheet. Thus, the two sheet ends can be accurately and easily joined at all times.

The other objects and characteristic features of the present invention will become apparent to those skilled in the art as the disclosure is made in the following description of a preferred embodiment of the invention, as illustrated in the accompanying drawings.

Figures 1, 3:
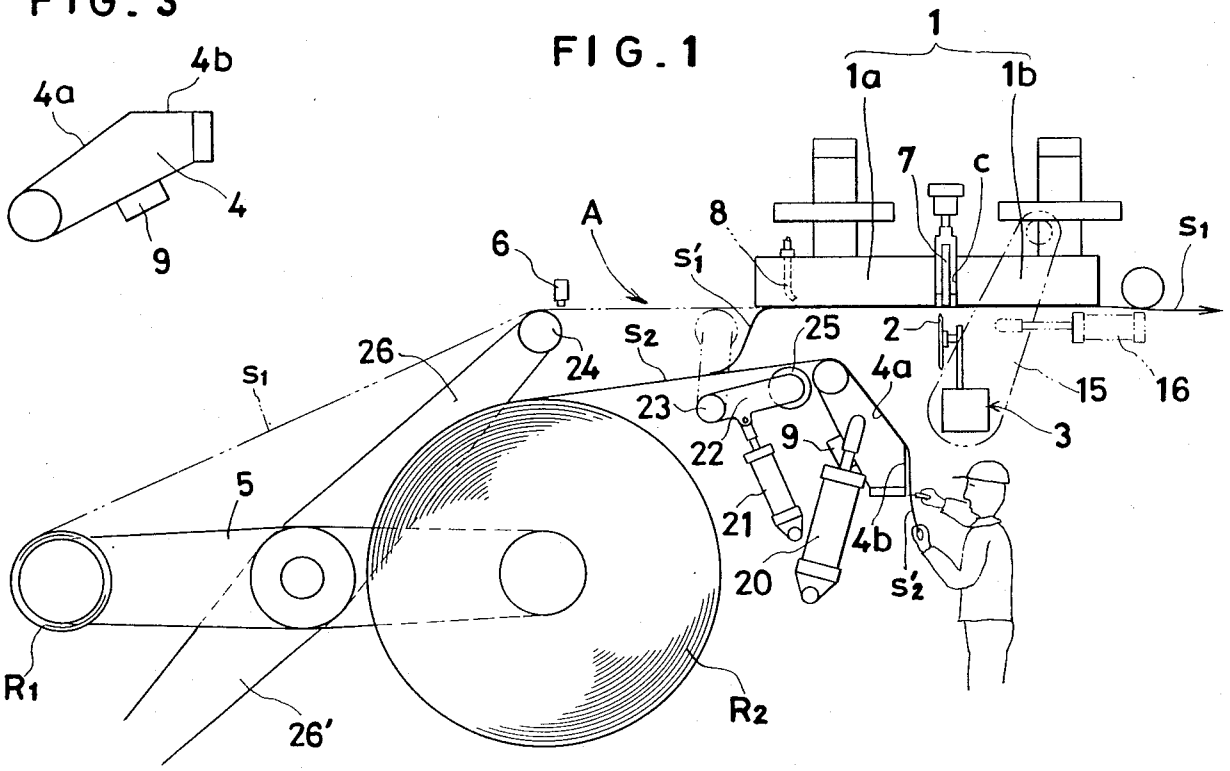
FIG. 1 is a side view illustrating a typical apparatus for joining sheet ends as one embodiment of this invention.
FIG. 3 is a side view illustrating a typical movable stand of the apparatus of the present invention.

DESCRIPTION OF PREFERRED EMBODIMENT:

Referring to FIG. 1, "A" denotes a path for the travel of a sheet $s_1$ from a roll. This sheet path is connected via a sheet drawing roll to a sheet fabricating device or a sheet winding device (not shown). On the upper side of the sheet path "A", two suction boxes 1*a*, 1*b* are disposed as separated by a small interval c in the direction of travel of the strip of sheet. These suction boxes have a width at least as large as the width of the sheet $s_1$ traveling thereunder. The suction boxes are either provided therein with or connected to a blower or a vacuum pump adapted to evacuate their interiors. When the vacuumizing means is operated, the sheet below is sucked to the lower sides of the suction boxes. In addition to the aforementioned vacuumizing means, the suction box 1a on the upstream side is provided with a jet nozzle 8 for spurting compressed air downwardly.

In the interval c between the two suction boxes 1*a*, 1*b*, a heating pressure beam 7 for thermal fusion of sheet ends is disposed so as to be vertically movable as guided by the opposed sides of the two suction boxes.

Blow the suction box 1*b* is disposed a sheet cutter 3. This sheet cutter 3 is adapted so that when it is moved to the cutting position and actuated to cut the sheet, it advances a circular blade 2 across the sheet along the lower end of the beam 7.

Figures 2A, 2B, 2C, 4, 5:
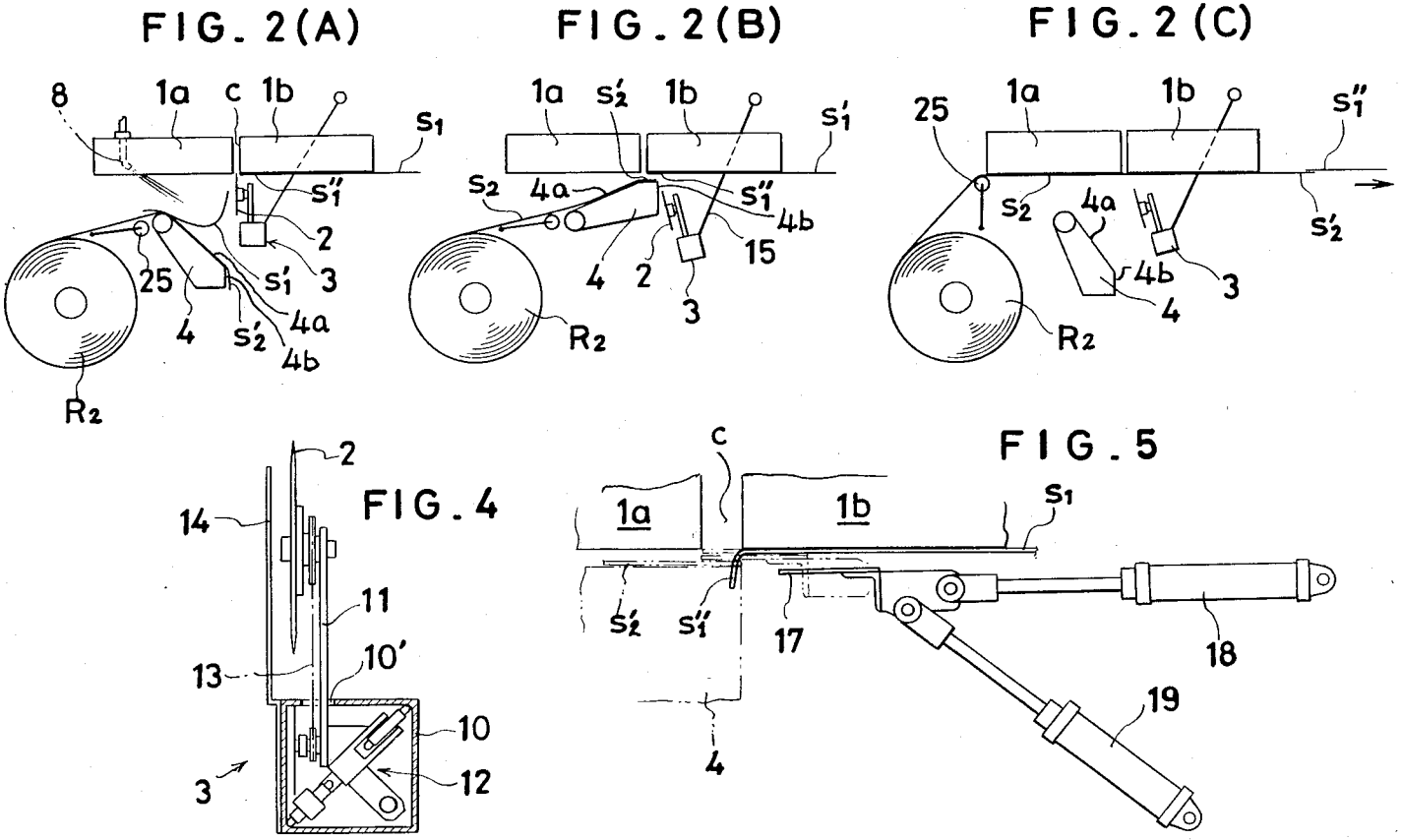
FIG. 2(A) is an explanatory diagram illustrating the trailing end of a sheet as sucked to a suction box of the apparatus and cut.
FIG. 2(B) is an explanatory diagram illustrating the leading end of a new sheet as cut and joined to the trailing end of the old strip of sheet.
FIG. 2(C) is an explanatory diagram illustrating two sheet ends already joined and started into motion.
FIG. 4 is a cross section illustrating a typical cutter of the apparatus of the present invention.
FIG. 5 is an explanatory diagram illustrating the operation of a support plate of the apparatus of the present invention.

A typical construction of the sheet cutter 3 is illustrated in FIG. 4. As illustrated, the sheet cutter 3 comprises an angular beam 10 possessing a slit 10' in the direction of length thereof, a travel member 12 allowed to travel inside the angular beam 10 with the opposed inner corners of the angular beam 10 acting as rails and with an arm 11 kept thrust out of the slit 10', the circular blade 2 disposed at the leading end of the arm 11, and a protective board 14 disposed as opposed to the circular blade 2. As the travel member 12 is caused to advance inside the angular beam 10 by traction with a chain (not shown), the circular blade 2 is rotated by a chain 13 and cuts the sheet.

As shown by a chain line in FIG. 1, the opposite ends of the angular beam 10 of the sheet cutter are supported in place by a pair of swing levers 15 having pivotally supported upper ends. The sheet cutter 3 is reciprocated between a cutting position and a waiting position by hydraulic cylinders 16 connected to the swing levers 15.

The structure of the sheet cutter is not necessarily limited to that described above, and any other structure capable of causing the blade to cut the sheet in the lateral direction may be used instead. For example, an electric heating wire, a traveling thin blade, or a saw-tooth blade may be used effectively.

As best shown in FIG. 2, on the upstream side of the sheet cutter there is disposed a movable receiving table 4 pivotably supported at one end thereof and used for joining sheet ends. This movable receiving table 4 possesses a guide face **4*a* and a support face 4*b* (FIG. 3). It is provided with or connected to vacuumizing means 9 such as a blower or a vacuum pump. By the operation of a cylinder 20 (shown in FIG. 1) this movable receiving table 4 is pivoted so that the guide face 4*a* is inclined to assume a position for preparing for sheet end joining and the support face 4*b* is brought under the interval c to assume a position for effecting sheet end joining. A guide roller 25 disposed in front of the suction box 1*a* is supported in place by an arm 22. The arm 22 is pivotally supported in place at the lower end thereof by a shaft 23. By the operation of a cylinder 21, the guide roller 25 is reciprocated between a position immediately below the sheet path A (indicated by the chain line in FIG. 1) and a waiting position (indicated by the solid line in FIG. 1**).

The pair of suction boxes **1*a*, 1*b*, the swing levers 15 supporting the sheet cutter 3, the movable receiving table 4, the cylinders 16, 20, 21, and the guide roller 25** are all fastened by suitable means to a base frame not shown in the drawing.

On a turret frame 5 of a sheet unreeler disposed on the upstream side of the sheet path relative to the sheet end joining apparatus constructed as described above, there are mounted a roll $R_1$ which is in the process of paying out the sheet $s_1$ and a new roll $R_2$. The roll $R_1$ is located at a more upstream position than the roll $R_2$. The sheet $s_1$ from the roll $R_1$ advances over a guide roller 24, under and a sensor 6 disposed along the path "A", and moves under the pair of suction boxes **1*a*, 1*b* toward the next step. The drawing of the sheet $s_1$ from the roll $R_1$ is effected by a sheet drawing roller (not shown) disposed downstream of the suction box 1*b***.

As the sheet $s_1$ unreeled from the roll $R_1$ is completely paid off the roll $R_1$, the sensor 6 detects the passage thereunder of the trailing end $s_1'$, of the sheet $s_1$ and causes the sheet drawing roller to stop. At the same time, the sensor 6 actuates the vacuumizing means of the pair of suction boxes **1*a*, 1*b***. As a result, the trailing end portion $s_1'$ of the sheet $s_1$ is brought to a stop and is sucked to the lower sides of the suction boxes.

Then, the hydraulic cylinder 16 is actuated to move the sheet cutter 3 from the waiting position to the cutting position. The circular blade 2 is then advanced, cutting the strip of sheet along the interval c separating the two suction boxes. Subsequently, the jet nozzle 8 disposed in the suction box **1*a* is operated to spurt compressed air diagonally downward to blow down the portion of the sheet from the cut end $s_1''$ to the trailing end adhering to the lower side of the suction box 1*a*. By this time, the movable receiving table 4 has been pivoted until the guide face 4*a* thereof assumes a position parallel to the direction of the spurted compressed air. The cut sheet $s_1'$, therefore, is allowed to slip down the guide face 4*a*. When the cut sheet $s_1'$ has a large thickness, the release of this cut sheet $s_1'$ from the suction box 1*a* may be effected simply by stopping the operation of the sucking means of the suction box 1*a***.

While the sheet $s_1$ is being unreeled from the roll $R_1$, the operator uses the cylinder 21 to move the guide roller 25 to its waiting position, draws the sheet $s_2'$ from the new roll $R_2$ mounted on the turret frame, passes it over the guide roller 25 kept in the waiting position, and drapes it on the movable receiving table 4 currently having the guide face **4*a* thereof kept in an inclined state. At this time, the operator actuates the vacuumizing means 9 of the movable receiving table, causes the strip of sheet $s_2'$ to be sucked onto the guide face 4*a*, smooths the sucked sheet end to remove wrinkles, if any, and cuts the sucked sheet along the end face of the support face 4*b*. This cutting work is of course not necessary when the leading end of the strip of sheet $s_2'$ is correctly aligned with the end face of the support face 4*b***. Then, on the cut end portion of the sheet, a suitable adhesive agent selected from among thermally fusible tape, double-face adhesive tape, paste, and mucilage to suit the material of the sheet is applied. The series of operations described above can be easily carried out by one operator because the sheet is sucked fast to the guide face of the movable receiving table.

When the sheet end $s_1'$ of the roll $R_1$ is draped down along the guide face **4*a* of the movable receiving table 4, as illustrated in FIG. 2(A), the sheet cutter 3 is moved to the waiting position. At or about the same time, the movable receiving table 4 is pivoted and elevated to the sheet joining position to bring the support face 4*b* thereof into pressed contact with the lower side of the interval c formed by the pair of suction boxes 1*a*, 1*b*. As a result, the leading end of the sheet $s_2$ from the new roll $R_2$ now resting on the support face 4*a* is attached to the cut end $s_1''$ of the sheet $s_1''$ sucked to the suction box 1*b* by the adhesive agent applied in advance (FIG. 2(B)). After union of the sheet ends has been confirmed, the vacuumizing means 9 of the movable receiving table 4 is stopped, and the movable receiving table 4 is pivoted and lowered to the preparation position. At or about the same time, the guide roller 25 is returned to below the sheet path "A", the vacuumizing means of the suction boxes 1*a*, 1*b* are stopped, and the sheet drawing roller is again set operating to start the rewinding of the sheet (FIG. 2**(C)).

Subsequently, the turret frame 5 is rotated counterclockwise to move the roll $R_2$ to the position so far occupied by the roll $R_1$ and a new roll is mounted in the freshly evacuated position. The leading end of the sheet from the new roll is kept waiting by being sucked fast to the support face of the movable receiving table 4 in the same manner as described above. When the turret frame is rotated as described above, an arm 26 supporting the guide roller 24 in place is simultaneously rotated and a roller disposed at the leading end of an arm 26' causes the strip of sheet $s_2$ from the roll $R_2$ to be guided and advanced along the sheet path "A".

In accordance with this invention, the joining of sheet ends can be accurately and easily carried out by simply rotating the movable receiving table from the position for preparing for sheet joining to the position for effecting sheet joining after exhaustion of the sheet from the roll being unwound is detected and the cut sheet end is blown down as described above.

When the material of the sheet being handled is such that the cut end of the sheet produced after the trailing end thereof is sucked to the suction boxes and cut droops down in the vicinity of the interval c and consequently the leading end of the sheet from the next roll held on the movable receiving table 4 cannot be joined to the drooping cut end, a thin support plate 17 supported by both a horizontal cylinder 18 and an inclined cylinder 19 is provided beneath the suction box 1*b* as illustrated in FIG. 5.

When the cut end $s_1''$ of the sheet $s_1$ droops down as described above, the two cylinders 18, 19 are operated to move the support plate 17 diagonally in the upward direction and to cause the cut end of the strip of sheet drooping down as indicated by the chain line to be positioned below the interval c separating the two suction boxes. Then, the movable receiving table 4 is elevated until the leading end $s_2'$ of the sheet from the next roll comes into contact with the rear side of the support plate 17. At this time, the support plate 17 is pulled out to establish contact between the cut end $s_1''$ of the old sheet and the leading end $s_2'$ of the next roll.

When union of the sheet ends is effected solely by the pressure of the movable receiving table 4, a rubber sheet applied on the front face of the support face 4b gives the surface a raised level and imparts sufficient elasticity thereto to ensure safe union. When the movable receiving table 4 has the sole function of guiding the leading end of the strip of sheet to the joining position, pressure exerted downwardly by the heating pressure beam 7 capable of vertically moving toward and away from the interval c as illustrated in FIG. 1 contributes to ensuring fast union. Generally, the union of the two sheet ends is accomplished by interposing an adhesive agent between the opposed faces of the two sheets ends and pressing the sheet ends against each other. Otherwise, the two sheet ends may be joined by the fusion obtained by heating the heating pressure beam 7 and pressing it against the superposed sheet ends.

In the illustrated embodiment, the attraction of sheets has been described as effected by the use of a vacuumizing means in conjunction with suction boxes 1a, 1b and a movable receiving table 4. The means for this attraction is not necessarily limited to this arrangement, however. For example, the suction may be effected by static electricity.

As will be surmised from the description given above, so long as the sheet path is formed at a level high enough for a person to stand safely thereunder and the movable receiving table is disposed under the sheet path, the operation of sheet end joining which ordinarily involves two to three operators in the conventional apparatus can be conveniently carried out by one operator in the case of the apparatus of this invention. In accordance with this invention, the union of sheet ends can be quickly and accurately accomplished without spoiling the appearance of the sheet being handled. The appaatus of this invention has another advantage in that, since the sheet advances above the operator, there is no possibility of the operator dropping an object onto the sheet in motion or soiling the sheet with foreign matter. While the movable receiving table 4 remains at its waiting position, it functions as a guide face for smooth fall of the trailing end of the sheet cut off. While the sheet end joining is in progress, the movable receiving table kept at its elevated position enables the leading end of the sheet readied for union to be set accurately at the position for union with the cut end of the preceding sheet. Once the two sheet ends are joined, the work of trimming the joined end which has been heretofore been indispensable is no longer required. Further the fact that the suction boxes are disposed on the sheet path contributes to advantageous utility of space.

What is claimed is:

1. An apparatus for cutting the trailing end of a preceding sheet which is unwound and separated from a supply roll and runs on a sheet path and joining to the cut end of the preceding sheet the leading end of the following sheet which is unwound from another supply roll, said apparatus comprising:

(a) an upstream suction box and a downstream suction box disposed above and adjacent to the sheet path, said suction boxes being separated by an interval and being provided with vacuumizing means for sucking the preceding sheet to the lower sides of said suction boxes;

(b) a sheet cutter disposed below the interval between said suction boxes for cutting the preceding sheet which has been sucked to the lower sides of said suction boxes;

(c) said downstream suction box holding in position the trailing end of the preceding sheet cut by said sheet cutter and said upstream suction box holding in position a waste portion of the cut preceding sheet; and (d) a movable receiving table disposed below the sheet path, said movable receiving table:

(i) having a support face for holding in position the leading end of the following sheet;

(ii) being movable between a lower position at which a space is left for allowing the waste portion of the cut preceding sheet to fall and the following sheet is set in advance on said support face and an upper position at which the leading end of the following sheet set on said support face is joined to the trailing end of the cut preceding sheet on the sheet path;

(iii) being on standby at its lower position before the waste portion of the cut preceding sheet falls from the sheet path; and, (iv) when the waste portion of the cut preceding sheet has fallen, moving to said upper position for joining the two sheet ends.

2. An apparatus according to claim 1, wherein said sheet cutter comprises:

(a) a tubular member having a slit running along the interval between said suction boxes;

(b) a travel member adapted to travel inside said tubular member;

(c) a cutting blade disposed on said travel member and thrust out of said; and (d) means for causing said cutting blade to run along the interval between said suction boxes.

3. An apparatus according to claim 2, wherein said upstream suction box is further provided with means for spurting compressed air for blowing off the trailing end of the cut preceding sheet sucked to the lower side of said suction boxes.

4. An apparatus according to claim 1, wherein each of said suction boxes incorporates a blower adapted to vacuumize the interior of the corresponding one of said suction boxes and to suck the strip of sheet onto the lower sides of said suction boxes.

5. An aparatus according to claim 1, and further comprising a pressure beam disposed above the sheet path and adapted to be vertically moved in the interval between said suction boxes.

6. An apparatus according to claim 1, wherein said movable receiving table incorporates a blower adapted to vacuumize the interior thereof and to suck the leading end of the following sheet onto said support face thereof.

7. An apparatus according to claim 1, and further comprising means for applying adhesive material onto the leading end of the following sheet held in place on said movable receiving table.

8. An apparatus for joining the trailing end of a preceding sheet to the leading end of a following sheet, said apparatus comprising:

(a) a pair of sheet suction boxes disposed adjacent to and above a sheet path, said pair of suction boxes being separated by an interval;

(b) means for evacuating the interior of each of said suction boxes;

(c) a pressure beam disposed adjacent the sheet path and adapted to be vertically moved in the interval separating said pair of suction boxes;

(d) a sheet cutter disposed below the interval separating said pair of suction boxes and adapted to cut the preceding sheets sucked to the lower side of said suction boxes; and (e) a movable receiving table disposed below the sheet path, said movable receiving table having a support face for holding in position the leading end of the following sheet, said movable receiving table being adapted to rise and to bring the leading end of the following sheet into contact with the cut end of the preceding sheet for joining the two sheet ends.

9. An apparatus according to claim 8 wherein said sheet cutter comprises:

(a) a tubular member having a slit running along the interval separating said pair of suction boxes;

(b) a travel member adapted to travel inside said tubular member;

(c) a cutting blade disposed on said travel member and thrust out of said slit; and (d) means for causing said cutting blade to run along the interval separating said pair of suction boxes.

* * * * *